US008083271B2

(12) United States Patent
Vilhauer

(10) Patent No.: US 8,083,271 B2
(45) Date of Patent: Dec. 27, 2011

(54) WINDOW LOCK AND SASH

(75) Inventor: Kevin D. Vilhauer, Puyallup, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 0 days.

(21) Appl. No.: 11/445,688

(22) Filed: Jun. 2, 2006

(65) Prior Publication Data

US 2007/0289220 A1 Dec. 20, 2007

(51) Int. Cl.
*E05C 1/02* (2006.01)

(52) U.S. Cl. ..... 292/137; 292/DIG. 47; 292/DIG. 7; 292/DIG. 20; 50/204.5

(58) Field of Classification Search ..... 292/32–33, 292/38, 44–45, 49–50, 140–141, 145–146, 292/195, 197, 198, 202, 203, 137, DIG. 70, 292/DIG. 47 X, DIG. 35, DIG. 20, DIG. 7, 292/54, 138; 50/204.5, 204.62, 204.69
See application file for complete search history.

(56) References Cited

U.S. PATENT DOCUMENTS

| | | | | | |
|---|---|---|---|---|---|
| 351,575 | A | * | 10/1886 | Case | 292/335 |
| 1,609,342 | A | * | 12/1926 | Winters et al. | 292/332 |
| 1,763,638 | A | * | 6/1930 | Bonner | 292/254 |
| 2,482,340 | A | * | 9/1949 | Holmsten | 292/346 |
| 3,099,050 | A | * | 7/1963 | Hetman | 49/421 |
| 3,837,191 | A | * | 9/1974 | Soiderer | 70/90 |
| 4,137,671 | A | | 2/1979 | Miller | |
| 4,138,150 | A | * | 2/1979 | Bills | 292/60 |
| 4,320,597 | A | | 3/1982 | Sterner, Jr. | |
| 4,356,667 | A | | 11/1982 | Malachowski | |
| 4,395,847 | A | | 8/1983 | Atchison | |
| 4,400,026 | A | | 8/1983 | Brown, Jr. | |
| 4,553,353 | A | | 11/1985 | Simpson | |
| 4,578,900 | A | | 4/1986 | Hannay | |
| 4,635,396 | A | | 1/1987 | Ranz et al. | |
| 4,791,756 | A | * | 12/1988 | Simpson | 49/175 |
| 4,869,020 | A | | 9/1989 | Andres | |
| 4,887,392 | A | | 12/1989 | Lense | |
| 4,958,468 | A | | 9/1990 | Nolan | |
| 4,961,286 | A | | 10/1990 | Bezubic | |
| 5,003,747 | A | | 4/1991 | Morton | |
| 5,127,685 | A | | 7/1992 | Dallaire et al. | |
| 5,326,141 | A | * | 7/1994 | Gorman | 292/66 |
| 5,618,067 | A | | 4/1997 | Carlson et al. | |
| 5,715,631 | A | * | 2/1998 | Kailian et al. | 49/450 |
| 5,901,501 | A | * | 5/1999 | Fountaine | 49/449 |
| 5,970,656 | A | | 10/1999 | Maier | |
| 5,992,907 | A | | 11/1999 | Sheldon et al. | |
| 5,996,283 | A | | 12/1999 | Maier | |

(Continued)

OTHER PUBLICATIONS

International Search Report for PCT/US2007/069765, date of mailing Feb. 18, 2008, 5 pages.

(Continued)

*Primary Examiner* — Carlos Lugo
*Assistant Examiner* — Mark Williams
(74) *Attorney, Agent, or Firm* — Rathe Lindenbaum LLP

(57) ABSTRACT

A window includes at least one movable sash having a horizontal rail with a horizontal top portion and a vertical portion extending downward from the horizontal top portion. A pull rail portion extends from the horizontal rail beyond the vertical portion. A latch is located below the pull rail and adjacent the vertical portion. The latch includes a pull handle configured to release a latching mechanism from one of a second sash or a frame.

20 Claims, 3 Drawing Sheets

U.S. PATENT DOCUMENTS

| | | | | |
|---|---|---|---|---|
| 6,155,615 | A | 12/2000 | Schultz | |
| 6,178,696 | B1 | 1/2001 | Liang | |
| 6,183,024 | B1 | 2/2001 | Schultz et al. | |
| 6,230,443 | B1 | 5/2001 | Schultz | |
| 6,279,266 | B1 | 8/2001 | Searcy | |
| 6,457,752 | B1 | 10/2002 | Miller et al. | |
| 6,485,070 | B1 | 11/2002 | Schultz | |
| 6,546,671 | B2 * | 4/2003 | Mitchell et al. | 49/185 |
| 6,604,324 | B1 | 8/2003 | Maier | |
| 6,607,221 | B1 * | 8/2003 | Elliott | 292/33 |
| 6,634,683 | B1 | 10/2003 | Brannan | |
| 6,722,712 | B2 | 4/2004 | Schultz | |
| 6,832,792 | B2 | 12/2004 | Polowinczak et al. | |
| 6,874,826 | B1 | 4/2005 | Polowinczak et al. | |
| 6,948,278 | B1 | 9/2005 | Schultz | |
| 7,063,361 | B1 | 6/2006 | Lawrence | |
| 7,069,694 | B2 | 7/2006 | Fullick | |
| 7,070,211 | B2 * | 7/2006 | Polowinczak et al. | 292/139 |
| 7,073,292 | B1 | 7/2006 | Minter et al. | |
| 2006/0033345 | A1 * | 2/2006 | Richardson | 292/175 |
| 2008/0129054 | A1 * | 6/2008 | Tremble et al. | 292/33 |

OTHER PUBLICATIONS

Written Opinion for PCT/US2007/069765, date of mailing Feb. 18, 2008, 13 pages.

* cited by examiner

WINDOW LOCK AND SASH

CROSS-REFERENCE TO RELATED PATENT APPLICATIONS

None.

BACKGROUND OF THE INVENTION

The present invention relates generally to the field of window locks, and more particularly to an improved window latch located under a sash. A window latch secures a window sash when it is in the closed. In sliding windows, where a window sash is slid relative to another sash, the latch is first released in order to slide the window to the open position. The window latch is typically placed on top of the movable sash and engages and disengages a latch plate on the other sash or window frame to lock and unlock the window. A window sash may also have a pull rail that extends outwardly to assist a user in opening and closing the movable sash. Accordingly, it would be advantageous to provide a window sash with both a pull rail and a front facing latch.

Often, when a user manipulates a latch for a window, the user slides the moveable sash by grasping the latch, imparting substantial stress on the latch perpendicular to the surface of the window (by pulling out or pushing in on the latch to disengage the locking mechanism) and in the direction of travel (by pulling on the latch to slide the sash). A user may also impart a substantial moment on the latch by grasping it "off-center." Accordingly, it would be advantageous to locate the latch such that a force applied to it by the user is resisted by structural elements of the window.

SUMMARY OF THE INVENTION

One embodiment of the invention relates to a window includes at least one movable sash having a horizontal rail with a horizontal top portion and a vertical portion extending downward from the horizontal top portion. A pull rail portion extends from the horizontal rail beyond the vertical portion. A latch is located below the pull rail and adjacent the vertical portion. The latch includes a pull handle configured to release a latching mechanism from one of a second sash or a frame.

In another embodiment, a window sash and latch includes a first sash with first and second spaced rails and a second pair of spaced rails being perpendicular to the first and second rails. A glazing is located between the first and second rails and the second pair of spaced rails. A latch is operatively connected to the first rail. The first rail includes a first surface extending perpendicular to the glazing and includes a pull rail extending therefrom in a direction away from the glazing. The latch is located adjacent a first surface of the first rail that is parallel to the glazing and located adjacent the pull rail. The latch includes a handle configured to release a latching mechanism from a second sash.

In a further embodiment a window includes a movable sash with a first rail and a second spaced rail parallel to the first rail. A glazing is located between the spaced rails. A pull rail extends from the first rail away from the glazing. The pull rail has a first surface facing away from the second rail and a second surface opposite the first surface facing toward the second rail. A latch is operatively coupled to the movable sash to releasably lock the movable sash relative to one of a second sash or a frame. The latch is located adjacent the first rail and adjacent the second surface of the pull rail.

DETAILED DESCRIPTION OF THE PREFERRED EMBODIMENTS

Before providing the description of the exemplary embodiments of the window lock and sash, it should be noted that the references to "up," "upper," rear," "front," "inner," and "outer" in this description are merely used to identify the various elements as they are oriented in the Figures and in relation to a particular embodiment of a window with vertically sliding portions, or sashes. The terms "up" and "upper" are used to reference a general vector direction away from the force of gravity or the direction a moveable sash moves as it is opened relative to a second sash. The term "rear" is used to describe the surface of the first sash that is proximate to or closer to the second sash, while the term "front" is used to describe the surface that a person would see facing the window from inside of a building structure. The term "inner" is used to reference a direction towards the interior and a person using the window, while the term "outer" is used to reference a direction towards the exterior and away from a person using the window.

It should also be noted that the term "rail" as used in the description describes the horizontal rail on the sash. However, when the latch mechanism is used on a horizontal sliding window, the term "stile" would be more appropriate. In the case of a horizontal sliding window, the term "up" would be the direction the first sash moves as the first sash is being opened relative to the second sash.

Figure 1:
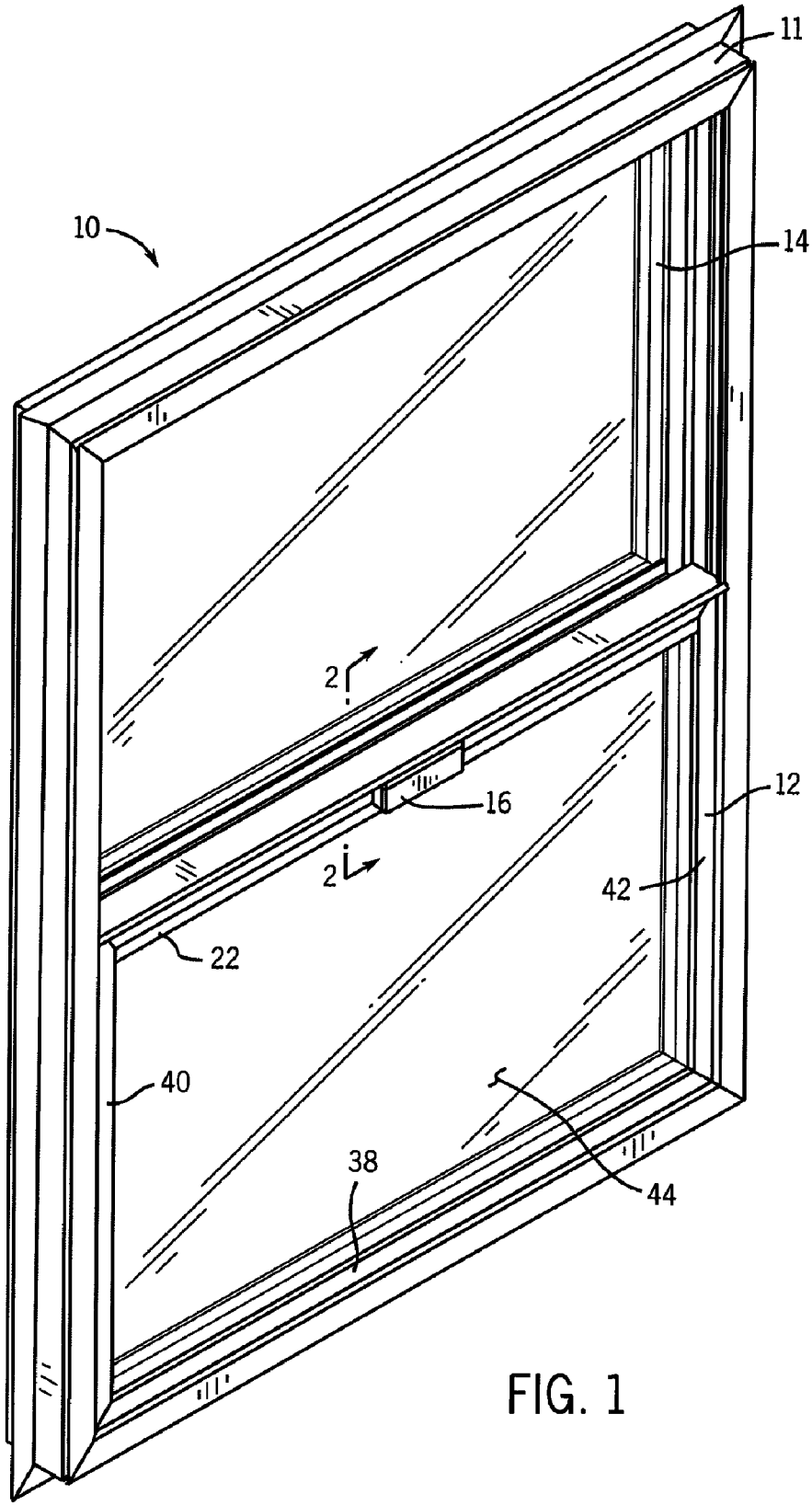
FIG. 1 is an isometric view of a window according to an exemplary embodiment in a closed and locked configuration.

Referring to FIG. 1, a window 10 is shown according to an exemplary embodiment comprising a frame 11, a first movable sash 12, a second sash 14, and a latch 16. Moveable sash 12 and sash 14 are generally mounted in frame 11 and allowed to slide vertically in frame 11 with moveable sash 12 sliding on an first, or inner track and sash 14 sliding on a second or outer track. Latch 16 is coupled to movable sash 12 and releasably engages sash 14. According to an exemplary embodiment, window 10 is vertically sliding window or a "double hung" window. According to other exemplary embodiments, the second sash may be fixed or "single hung" window. According to still other exemplary embodiments, the window could be a horizontally sliding window.

Figure 2:
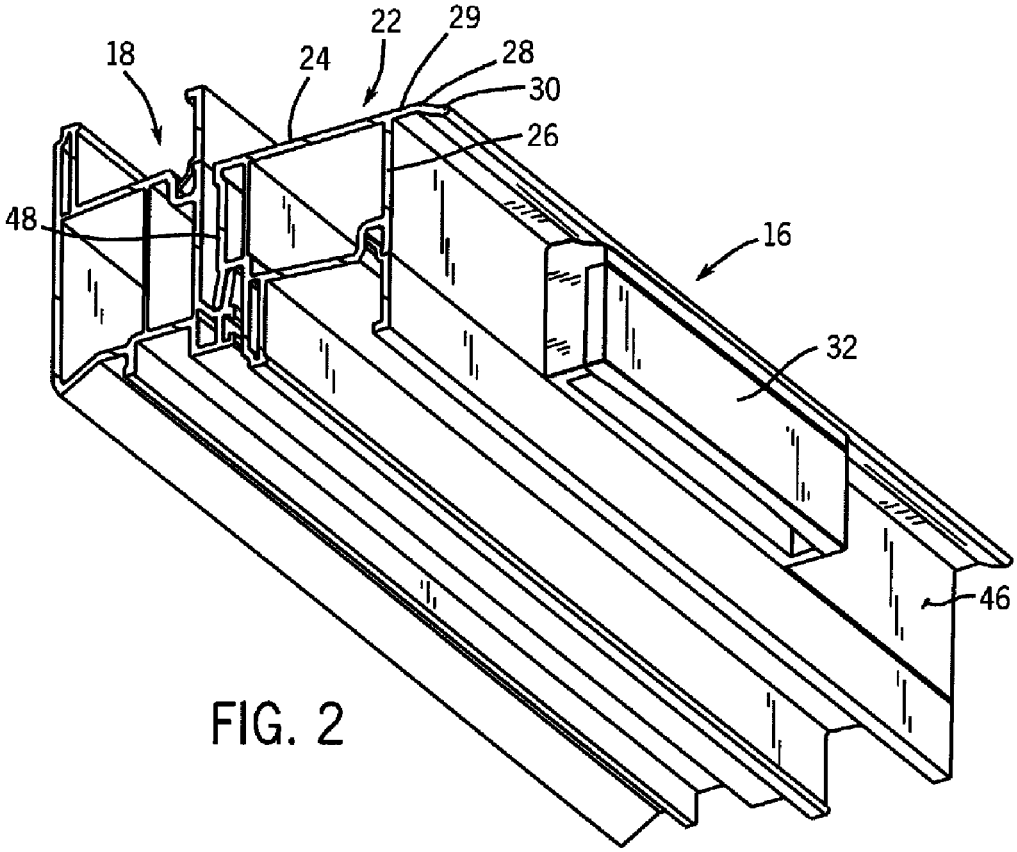
FIG. 2 is a partial isometric view of the window in FIG. 1.
Figure 3:
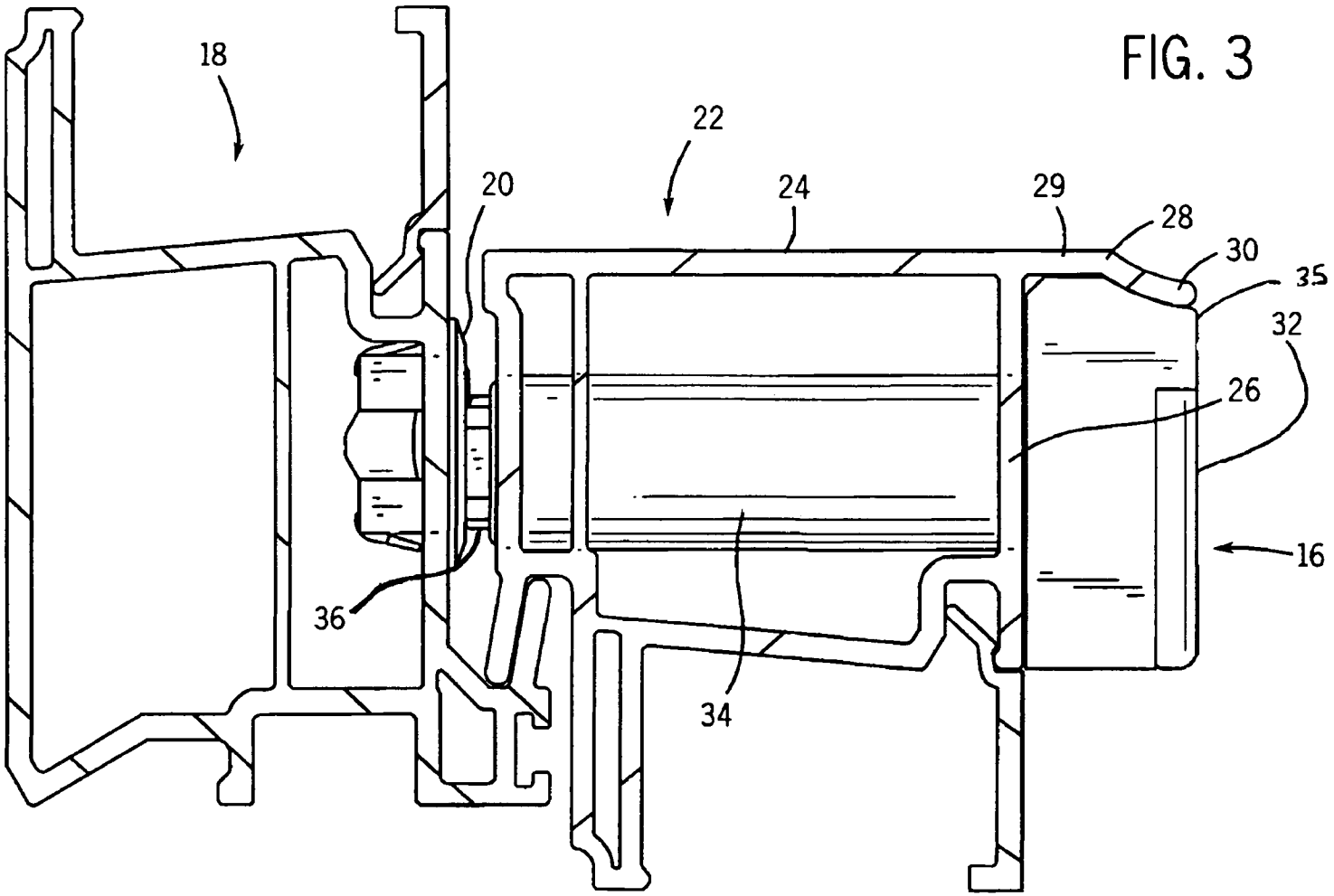
FIG. 3 is a partial cross-section of the window in FIG. 1 taken generally along line 2-2 of FIG. 1.

Referring now to FIGS. 2-3, a portion of window 10 is shown according to an exemplary embodiment, focusing on the portion of window 10 where moveable sash 12 and sash 14 are coupled when window 10 is in a locked configuration. Movable sash 12 includes an upper horizontal rail 22 that defines the upper edge of moveable sash 12 and comprises an upper horizontal wall 24, a front vertical wall 26, and a pull rail 28. Pull rail 28 is a protrusion (lip, rim, ledge, etc.) that provides a convenient structure for a user to use to raise and or lower the movable sash 12. Pull rail 28 extends away from horizontal wall 24 in an inward direction defined by a vector extending from sash 14 toward the movable sash 12. The inward direction is defined by the direction from the window toward the user as the user faces the window. In an exemplary embodiment pull rail 28 extends beyond vertical wall 26 in the inward direction and comprises a first portion 29 that is generally horizontal and continuous with horizontal wall 24, and a second portion 30 that curves and/or angles downward. Other configuration of a pull rail that provides a user with a surface to lift the sash are also contemplated.

Sash 14 includes a lower horizontal rail 18 that defines the lower edge of sash 14. Horizontal rail 18 includes a feature, shown schematically as latch plate 20 that is configured to receive a locking mechanism or portion of latch 16 as described in greater detail below.

Latch 16 is operatively coupled to vertical wall 26 of moveable sash 12 below pull rail 28 and is configured to selectively releasably couple and lock moveable sash 12 to sash 14. As noted above latch 16 may be used on a sliding window including horizontal sliding windows and vertical sliding windows. While the latch 16 may be used with different types of sliding windows including those identified above, latch 16 will be described relative to a vertical sliding window. Latch 16 includes a handle 32, a bezel or housing 35, a main body 34, and a locking mechanism 36, shown schematically in FIG. 3 as a bolt. Main body 34 houses a mechanism to transfer user input to locking mechanism 36 and, according to an exemplary embodiment, is mounted in horizontal rail 18. Locking mechanism 36 engages latch plate 20 and prevents moveable sash 12 from sliding vertically relative to sash 14. To unlock window 10, user manipulates handle 32 (e.g. by pushing, pulling, or pivoting) which disengages locking mechanism 36 and allows moveable sash 12 to slide relative to sash 14. Handle 32 is shown schematically in the Figures. Handle 32 may be pivotally attached to bezel 35 or may be configured to be pushed or pulled relative to bezel or housing 35. Further handle 32 may include a slideable mechanism and movable back and forth relative to the frame in a direction parallel to the glazing.

The location of latch 16 under pull rail 28 provides resistance to movement for latch 16 on at least three sides or directions. However, latch 16 may be supported in more or less vector directions as well. In an exemplary embodiment latch 16 is supported on the rear by vertical wall 26, on the top by pull rail 28, and on the front by second portion 30 of pull rail 28. The location of latch 16 proximate to pull rail 28 allows a substantial portion of the force placed on it by a user to be resisted by the structure of the sash itself instead of by latch 16. A force applied by a user on latch 16 by pulling latch 16 to disengage locking mechanism 36 is resisted by second portion 30 of pull rail 28. An upward force applied by a user on latch 16 by pulling up on latch 16 to slide moveable sash 12) is resisted by pull rail 28. A force applied by a user on latch 16 by pushing may be resisted by a portion of vertical wall 26.

Referring to FIGS. 1 and 2, sash 12 includes a first pair of parallel rails 22, 38 and a second pair of parallel rails 40, 42. A glazing 44 is located intermediate rails 22, 38, 40 and 42. Rail 22 includes a front vertical face 46 and a rear vertical face 48.

It is important to note that the construction and arrangement of the latch and sash as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. Further, the latch may be centrally located between two ends of the rail or maybe located off center. Additionally, there may be one or more latches on a single movable sash. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A window sash and latch arrangement comprising:

a window having at least one movable sash having a first horizontal rail spaced from a second horizontal rail;

a glazing extending between the first horizontal rail and the second horizontal rail;

the first horizontal rail including a horizontal top wall having an upper surface and an opposing lower surface, a first vertical wall extending downward from the lower surface of the horizontal top wall, and a second vertical wall extending downward from the lower surface of the horizontal top wall and spaced from the first vertical wall, the second vertical wall having a rear face opposite a front face, the rear face facing the first vertical wall;

a pull rail extending from the first horizontal rail beyond the front face of the second vertical wall in a direction away from the first vertical wall, the pull rail comprising a first portion extending horizontally outward in the same plane as the horizontal top wall of the first horizontal rail and a second portion extending generally downwardly and outwardly from the first portion; and wherein the pull rail extends substantially across the entire width of the glazing in the movable sash;

a latch including a handle located below the pull rail and configured to release a locking mechanism from one of a second sash or a frame in response to a force applied by a user, the latch including a portion that extends from the second vertical wall in a direction away from the first vertical wall and is adjacent a lower surface of the first portion of the pull rail and a lower surface of the second portion of the pull rail, any upward force applied by the user to the latch though the handle is resisted by the first portion of the pull rail, any outward force applied by the user to the latch through the handle is resisted by the second portion of the pull rail and any inward force applied by the user to the latch through the handle is resisted by an outward face of the second vertical wall of the movable sash.

2. The window sash and latch arrangement of claim 1, wherein the second portion of the pull rail curves downward from an end of the first portion of the pull rail.

3. The window sash and latch arrangement of claim 1, wherein the second portion of the pull rail extends at a downward angle from an end of the pull rail.

4. The window sash and latch arrangement of claim 3, wherein the latch includes an upper member that is located adjacent to the first and second portions of the pull rail.

5. The window sash and latch arrangement of claim 4, wherein the latch includes a housing and the handle is pivotally attached to the housing.

6. The window sash and latch arrangement of claim 5, wherein the latch includes a main body extending transversely and at least partially through the first horizontal rail, and the handle pivots upwardly and away from the sash to move the locking mechanism in a reciprocating manner within the main body to activate the latch.

7. A window sash and latch arrangement comprising:

a movable sash having a first pair of spaced rails and a second pair of spaced rails, the second pair of spaced rails being perpendicular to the first pair of spaced rails;

a glazing extending between the first pair of spaced rails and the second pair of spaced rails; and a latch including a handle and being operatively connected to one of the rails; the one rail including a first surface extending perpendicular to the glazing and including a pull rail extending therefrom in a direction away from the glazing, the pull rail having:

a first portion perpendicular to the glazing to resist a force applied by a user to the latch from in a first direction parallel to the direction the movable sash moves as it is opened, and a second portion extending from the first portion in a plane that is not planar with the plane of the first portion of the pull rail and is also not coplanar with the glazing, the second portion of the pull rail resisting a force applied to the latch from a second direction that is different from the first direction;

the handle of the latch being configured to release a locking mechanism from a second sash;

the first portion of the pull rail extending substantially coplanar with a surface of the one rail that is substantially perpendicular to the glazing; and the latch being supported by the first portion of the pull rail and the second portion of the pull rail.

8. The window sash and latch arrangement of claim 7, wherein the second portion of the pull rail extends from the first portion toward the latch, the second portion defining a contour that mates with a corresponding contour on the latch.

9. The window sash and latch arrangement of claim 8, wherein the latch includes a housing that engages the first and second portions of the pull rail.

10. The window sash and latch arrangement of claim 9, wherein the handle is pivotally attached to the housing.

11. The window sash and latch arrangement of claim 10, wherein the handle pivots away from the glazing to unlock the first sash from the second sash.

12. The window wash and latch arrangement of claim 9 wherein the latch housing is adjacent a portion of the one rail that is parallel to the glazing, wherein, the portion of the rail that is parallel to the glazing resists a force by a user to the latch and handle that is inwardly towards the glazing, the pull rail extending substantially across the entire width of a glazing in the movable sash.

13. The window sash and latch arrangement of claim 7 wherein the second portion of the pull rail extends generally downwardly and outwardly.

14. A window sash and latch arrangement comprising:

a movable sash including:

a first rail;

a second rail spaced parallel to the first rail; and a glazing extending between the first and second rails;

wherein the first rail has a rear vertical face and a front vertical face, the rear vertical face being between the glazing and the front vertical face;

an outwardly and downwardly extending pull rail that extends outwardly from the front vertical face of the first rail away from one of a second sash or frame and downward toward the second rail; and a latch being operatively coupled to the movable sash to releasably lock the movable sash relative to the second sash or a frame, the latch having a housing, the housing supported by the front vertical face of the first rail and having a top surface substantially covered and supported by the outwardly and downwardly extending pull rail;

wherein the pull rail extends substantially across the entire width of the glazing in the movable sash.

15. The window sash and latch arrangement of claim 14, wherein a force applied to the latch to move the movable sash to the open position is transferred to the pull rail.

16. The window sash and latch arrangement of claim 15, wherein the pull rail includes a first portion and a second portion extending generally outwardly and downwardly from the first portion, wherein the force applied to the latch is transferred to the pull rail in both a vertical and a non vertical direction.

17. The window sash and latch arrangement of claim 14, wherein the pull rail extends substantially across the first rail.

18. The window sash and latch arrangement of claim 14, wherein the latch extends through the first rail and into the second sash or frame in a locked position.

19. The window sash and latch arrangement of claim 14, wherein the latch is centrally located on the first rail.

20. A window sash and latch arrangement comprising:

a window having at least one movable sash, the movable sash including a first rail spaced from and substantially parallel to a second rail;

the first rail including a horizontal top wall having an upper surface, a first vertical wall extending downward from the lower surface of the horizontal top wall, and a second vertical wall extending downward from the lower surface of the horizontal top wall and spaced from the first vertical wall, the second vertical wall having a rear face opposite a front face, the rear face facing the first vertical wall;

wherein the first vertical wall is disposed proximate to a second sash or frame relative to the second vertical wall;

a pull rail extending from the first rail beyond the front face of the second vertical wall in a direction away from the first vertical wall; and a latch including a housing, the housing supported by the front vertical face of the second vertical wall and having a top surface substantially covered by the pull rail, a locking mechanism extending at least partially into the second sash or frame when engaged, and a handle located below the pull rail and configured to disengage the locking mechanism in response to a force applied by a user, any upward force applied by the user to the latch though the handle is resisted by the first portion of the pull rail, any outward force applied by the user to the latch through the handle is resisted by the second portion of the pull rail and any inward force applied by the user to the latch through the handle is resisted by the front face of the second vertical wall of the movable sash;

wherein the pull rail extends substantially across the entire width of a glazing extending between the first rail and the second rail of the movable sash.

* * * * *

UNITED STATES PATENT AND TRADEMARK OFFICE

CERTIFICATE OF CORRECTION

PATENT NO. : 8,083,271 B2
APPLICATION NO. : 11/445688
DATED : December 27, 2011
INVENTOR(S) : Kevin D. Vilhauer It is certified that error appears in the above-identified patent and that said Letters Patent is hereby corrected as shown below:

In Claim 7, column 5, line 12, the word "from" in between the word "latch" and "in" should be removed to read: "force applied by a user to the latch in a first direction parallel to the direction...".

Signed and Sealed this
Twenty-eighth Day of August, 2012

David J. Kappos

David J. Kappos
*Director of the United States Patent and Trademark Office*